United States Patent [19]

Bemis et al.

[11] 4,319,365

[45] Mar. 16, 1982

[54] NO TOOL TOILET SEAT HARDWARE

[75] Inventors: Richard A. Bemis, Sheboygan; Gordon Kelly, Elm Grove, both of Wis.

[73] Assignee: Bemis Manufacturing Company, SheboyganFalls, Wis.

[21] Appl. No.: 120,133

[22] Filed: Feb. 11, 1980

[51] Int. Cl.[3] ..... A47K 13/12

[52] U.S. Cl. ..... 4/236; 4/240

[58] Field of Search ..... 4/236, 240; 16/128 R, 16/129

[56] References Cited

U.S. PATENT DOCUMENTS

| | | | |
|---|---|---|---|
| 1,038,834 | 9/1912 | Bloom | 4/240 |
| 1,120,410 | 12/1914 | Rohmer et al. | 4/240 |
| 3,301,121 | 1/1967 | Newcomer | 4/240 X |
| 3,308,483 | 3/1967 | Miller | 4/236 |
| 3,570,021 | 3/1971 | Watson | 4/240 |
| 4,087,884 | 5/1978 | Seiderman | 4/236 X |

*Primary Examiner*—Henry K. Artis

*Attorney, Agent, or Firm*—Dressler, Goldsmith, Shore, Sutker & Milnamow, Ltd.

[57] ABSTRACT

A device for joining a toilet seat and cover to a commode without using tools and from only one side. A base assembly is attached to the commode using a bolt rotated by a hand graspable head portion. A cover conceals the bolt assembly from view. In one embodiment the head portion of the bolt folds out of sight and into engagement with the base; a cover, attached to the base then folds over the handle. In another embodiment the head portion of the expanding bolt folds into the base; the base and the folded head forming complementary interlocking structures disguising the bolt assembly. The bolt employs a nut indexed to a slit on the stem portion of the base. Manipulating the head portion of the bolt draws the nut into engagement with the stem. The outward flaring of the stem anchors the bolt in the mounting holes of the commode. The head portion of the bolt holds the base on the commode. In one embodiment the stem is separable from the base.

16 Claims, 8 Drawing Figures

FIG. 5
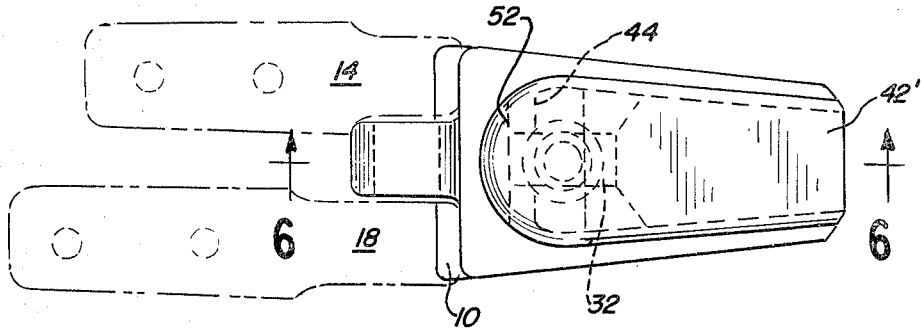
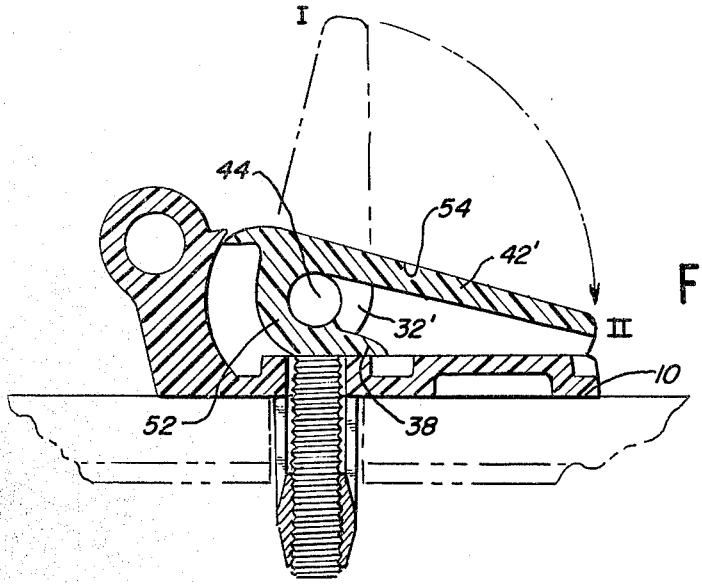
FIG. 6
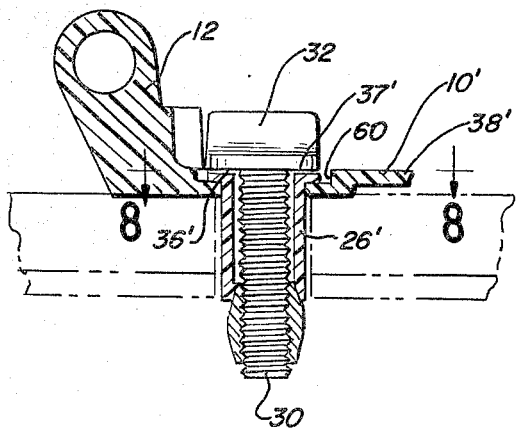
FIG. 7
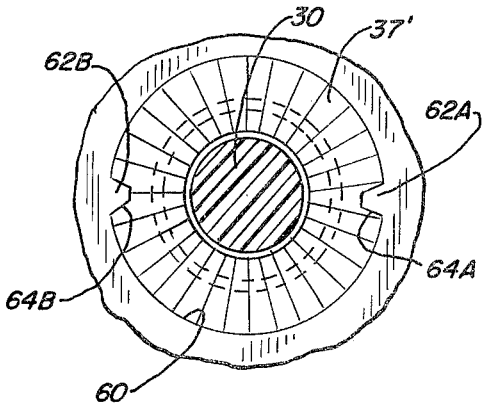
FIG. 8

NO TOOL TOILET SEAT HARDWARE

TECHNICAL FIELD

My invention relates to apparatus used to join a toilet seat and cover to commode. In particular it relates to the hardware used to fasten the hinge portion of the toilet seat and cover to the commode without the use of additional hand tools.

BACKGROUND OF THE INVENTION

The difficulty experienced in attaching a toilet seat and cover to the main frame or commode portion of a water closet is well known and documented. The inaccessibility and the usually cramped surrounding makes the job of attaching the seat and cover an onerous, if not a loathsome task. Others have sought to reduce the difficulty of this task by designing attachment devices that need only be manipulated from the upper portion of the commode; Watson (U.S. Pat. No. 3,570,021) describes a topinstallable toilet seat hinge post. Although the installation of a toilet seat and cover is made somewhat easier by eliminating the need to manipulate bolts and hardware on the underside of the commode, hand tools were still needed to do the job properly. This is not only inconvenient but a source of further difficulty; dropping tools in the commode adds to the frustrations of the installer.

In addition, it is common experience that, through use, the toilet seat and cover become loose. Newcomer (U.S. Pat. No. 3,301,121) describes an anti-wobble assembly employing resilient components to insulate the non-resilient members from contact with the commode thereby preventing the annoyance and inconvenience experienced by a user of a loose seat. It would be desirable to have toilet seat hardware in which the seat and cover could be easily and conveniently installed and adjusted in place without the need for extra tools.

DISCLOSURE OF THE INVENTION

The invention described below provides; a unique means for attaching a toilet seat and cover assembly to a commode without the need for hand tools; a means for adjusting and tightening the seat and cover assembly quickly and easily; and a means for disguising or hiding from view the hardware associated with joining the toilet seat and cover assembly to the commode thereby adding to the overall aesthetic appearance of the water closet. In addition, by providing a cover for the mounting hardware, the upper portion of the commode is made resistant to the accumulation of dirt and debris usually found in the vicinity of conventional toilet seat assemblies.

It should also be noted that in previous embodiments of the expanding bolt variety used to mount a toilet seat, frictional contact (Wilham U.S. Pat. No. 3,449,774) or an interlocking nut and sleeve (Watson U.S. Pat. No. 3,570,021) was used to fix the nut relative to the stem portion. While it is true that frictional contact can be used to engage the nut and stem, there is no positive assurance that the two will in fact engage. In particular, with modern trend to use plastics and polymer materials the coefficient of friction between components of the same material is very low. For this reason the nut in the invention described below employs an indexing means, namely, a tab that engages a slitted stem to insure that there is no relative motion between the nut and the stem as the bolt is tightened.

Furthermore, if metalic (non-plastic) and semi-rigid sleeves are used, considerable force must be used to expand the sleeve in the mounting hole. In addition, these rigid materials do not readily relax once the nut and bolt are tightened together. This precludes removal and often necessitates destruction and disposal of the seat and installation of a new one. The relaxation and flaring properties of the stem are enhanced by the slited stem feature. Thus, slited stem design of the present invention not only makes installation by hand easy, but also allows removal and reuse on another commode.

In accordance with the present invention a bracket or base means is provided for attaching a toilet seat and a cover to the upper portion of the commode without tools. A nut and bolt assembly is used to anchor the base and hinge supports used to join the toilet seat and cover to the commode. The upper portion or head of the nut and bolt assembly includes a rotatable hand-graspable member or handle.

To install the seat and cover assembly, one needs only to insert the two anchor bolts joined to the base into the bracket holes provided in the upper portion of the commode. Since the diameter of the nut or lower portion of bolt is small enough to pass through the bracket mounting holes, the seat assembly can be installed without having to manipulate or adjust the nut portion of the assembly.

To fixedly attach the seat assembly to the commode, the installer needs only to manipulate a rotatable head or handle portion of the bolt assembly. Turning the bolt head in the tightening direction draws the nut portion into engagement with a stem carried by the base. Since the nut includes an inclined upper portion engaging the stem, and since the stem portion of the base has been partially split, continued engagement of the nut and bolt forces the nut into engagement with the stem which causes the stem to flare outwardly to fill the mounting holes. This establishes a strong frictional fit between the stem and the mounting holes. It also positions the base on the commode and at the same time provides a means for anchoring the base to the commode.

A common feature of the various embodiments of the invention is that upper portion of the bolt assembly is made sufficiently large so as to be easily manipulated by hand. In one embodiment, the hand-graspable portion folds down and fairs with the base assembly. Thus, after installation of the seat and cover, the bolt assembly is hidden from view. In another embodiment a separate cover is installed to hide the bolt assembly. In a third embodiment a molded cover, integrally connected to the base, is fitted over the bolt assembly so as to envelope the handle portion of the bolt and hide it from view. In the fourth embodiment, a non integral slitted stem is attached to the base. In all cases, to adjust a bolt assembly it is only necessary to remove the cover to manipulate the upper portion of the bolt assembly by hand.

Numerous other advantages and features of the present invention will become readily apparent from the following detailed description of the invention and embodiments thereof, from the claims and from the accompanying drawings in which each and every detail shown is fully and completely disclosed as a part of this specification, in which like numerals refer to like parts.

BRIEF DESCRIPTION OF THE DRAWINGS

FIG. 5 is an overall plan view of a third embodiment of an apparatus incorporating the present;

FIG. 6 is a partial cross-sectional elevational view taken along line 6—6 of FIG. 5;

FIG. 7 is a partial cross-sectional elevational view of a fourth embodiment of an apparatus incorporating the present invention; and FIG. 8 is a fragmentary cross-sectional plan view of the upper portion of the stem when viewed along line 7—7 of FIG. 7.

BEST MODE FOR CARRYING OUT THE INVENTION

While this invention is susceptible of embodiment in many different forms there is shown in the drawgings and will be described in detail preferred embodiments with the understanding that the present disclosure is to be considered an exemplification of the principles of the invention and is not intended to limit the invention to the embodiments illustrated.

Figure 1:
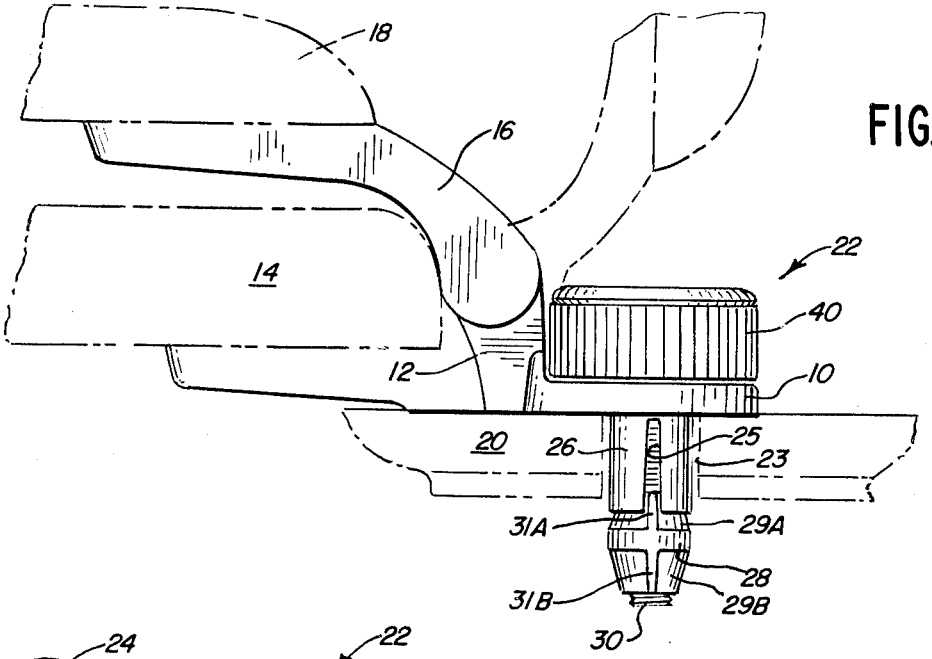
FIG. 1 is an overall elevation view of one embodiment with a cutaway section illustrating the major components of an apparatus embodying the invention.

In FIG. 1, the base structure 10 is the common point of connection for the principal components of the apparatus embodying the invention. A hinge assembly 12 for the seat or ring 14 and a hinge 16 for the lid or cover 18 of the commode 20 are attached to the base 10. Illustrated in phantom in FIG. 1 is the position of the lid 18 of the commode 20 when in the raised or upright position. The base 10 is attached to the main casting or commode section 20 of the toilet or water closet by means of an expanding bolt assembly 22 fitted within mounting holes or stud holes 23 in the commode 20.

Figure 2:
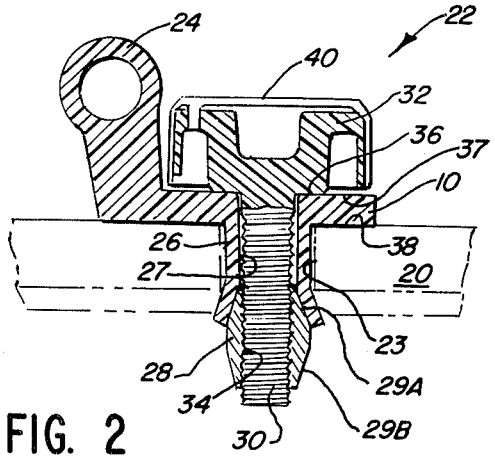
FIG. 2 is a cross-sectional elevational view of the embodiment of FIG. 1.

FIG. 2 illustrates a cross section of the attachment device shown in FIG. 1. This includes an ear or fixed hinge portion 24 and a lower or stem portion 26. The nut and bolt assembly 22 is fitted within the stem 26. The nut and bolt assembly 22 is used to engage the stem 26 with the mounting holes. Drawing the nut 28 and the bolt 30 together forces the stem portion 26 of the base to flare outwardly to fill the mounting hole 23 thereby anchoring the base 10 to the commode 20.

In all of the various embodiments about to be described, a unique expanding bolt assembly is used to join the seat and cover to the commode mounting holes 23. The essential components are illustrated in FIGS. 1 and 2. The stem portion 26 of the base 10 is located between the bolt portion 30 of the nut and bolt assembly 22 and the bore 23 of the mounting holes 23. At the lower end of the bolt 30 is a nut 28. The nut 28 also includes indexing tabs 31A, 31B matching with a slit 25 in the stem 26. The slit and tab prevent relative motion between the stem 26 and the nut 28. Although only one slit 25 is shown, a second slit may be located on the opposite side of the stem 26. Similarly, two sets of tabs that are set on each side of the nut 28 may be provided.

The slit 25 defines the point of separation for the stem as the nut and bolt are drawn together. In particular, since the outer diameter of the nut 28 is greater than the inner diameter of the stem 26, the stem will be forced to expand or outwardly flare from its original configuration to engage the mounting hole 23 of the commode 20. Further tightening of the bolt 30 not only draws the stem 26 into further contact with the mounting holes, but also forces or increases the compressive loading between the upper portion of the bolt 32 and the upper portion of the base 38.

As shown in FIG. 1, the nut 28 is symmetrical about a plane perpendicular to the axis of the nut. Thus, for purpose of assembly, the nut 28 may be attached to the bolt 30 without regard to the position of the tabs 31A, 31B. A symmetrical nut of the type described is recommended for convenience of the assembler and the installer in that it makes the installation process virtually "foot proof" from the standpoint of the do-it-yourselfer.

In the particular embodiment illustrated in FIGS. 1 and 2, the bolt 22 features a large easily graspable head portion 32. A head portion in the form of a raised tab will function equally as well. This head portion 32 is designed to be manually rotated to draw the nut 28 along the shaft 34 of the bolt 30 to expand the stem 26 into a mounting hole 23. A shoulder 36 on the head portion 32 of the bolt bears down on the upper surface 38 of the base 10 to joint the base 10 to the commode 20. After the base 10 has been installed a separate decorative cover 40 may be installed over the head portion 32 of the bolt to conceal the bolt 30 from view and otherwise improve the overall aesthetic appearance of the assembly.

Figure 4:
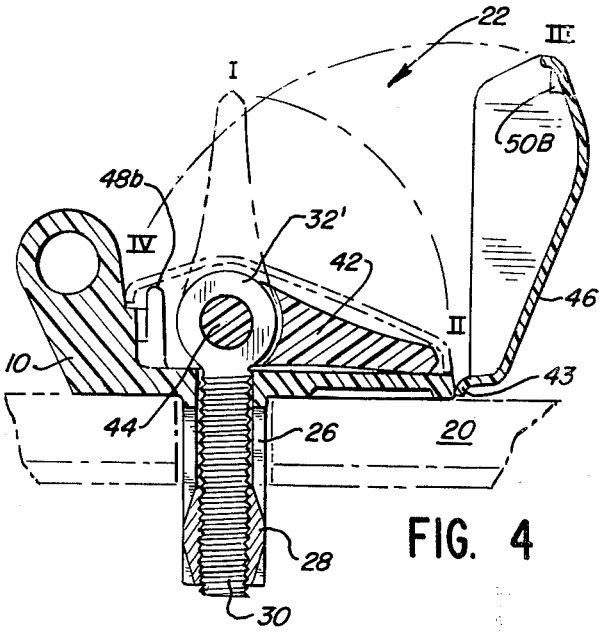
FIG. 4 is a partial cross-sectional elevational view taken along line 4—4 of FIG. 2.
Figure 3:
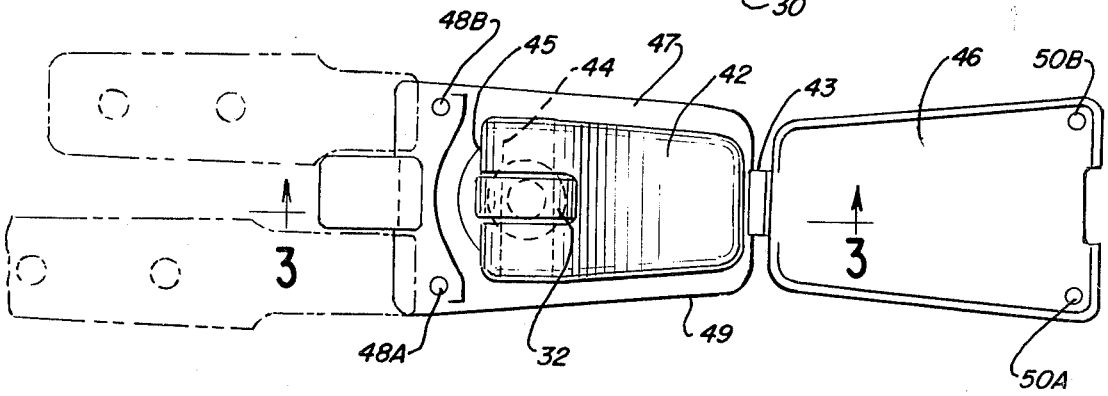
FIG. 3 is a partial plan view illustrating a second embodiment of an apparatus incorporating the present invention.

FIGS. 3 and 4 illustrate another embodiment of the present invention. It includes the same nut and bolt assembly 22 previously discussed and a unique head portion. The head portion 32′ of the bolt is in the shape of an eye. Attached to the eye portion of the bolt is a hand-graspable or handle structure used to force the nut and bolt together and to join the base to the commode. In particular, a handle 42 is joined to the eye portion 32′ of the bolt by a shaft 44. The handle has a clevis shaped end 48 strattling the eye portion 32′. The shaft 44 passes through the clevis holes and eye. The handle is rotatable between a raised (shown in phantom in FIG. 4 and designated by Roman Numeral I) and a lowered (II) position. In the raised position, it is of sufficient size to be easily grasped by the thumb and forefingers of the hand.

After the nut and bolt assembly 22 has been sufficiently tightened, the handle 42 is folded to the lowered position (II), as illustrated in FIG. 4, where a cover 46, integrally connected to the base 10 portion by a living hinge 43, may be rotated to a lowered position (illustrated in phantom in FIG. 4 and designated by Roman Numeral IV) to envelope and enclose the nut and bolt assembly 22. FIG. 3 illustrates the handle 42 rotated to the lower position and how the cover 46 passes over it to mate with the base and hide the bolt structure from view. The cover 46 is held in the lowered position on the base 10 by two snap-fitting tongues 48A and 48B and grooves 50A and 50B following a method well known by a person skilled in the art. The cover 46 may be hinged to the base 10 along the two other free edges 47 and 49 using the same principle to hide the nut and bolt assembly 22 from view.

Should it become necessary to re-adjust the nut and bolt assembly 22, one needs only to pull the cover 46 from the base to expose the nut and hardware. The handle 42 then may be lifted and used to tighten or adjust the seat or hinges.

FIGS. 5 and 6 illustrate a third embodiment of the invention. In this design the handle portion 42 of the nut and bolt assembly 22 has been specially shaped and configured relative to the base so that when it is in the lowered position it fairs or blends with the base 10 without requiring a separate cover.

In FIG. 5 the handle portion 42' is in the lowered position. In particular, when the handle 42' is raised (as shown in phantom in FIG. 6 and identified with Roman Numeral I) it is in position for drawing the nut and the bolt together as previously described. The handle 42' is free to pivotally swing between raised and lowered position just as in the embodiment previously described. The handle portion 42' is defined by a first surface 52 which is engageable with the upper portion of the base 38 and a second surface 54 which is manipulated by hand and which mates with the base 10 when in the folded or lowered position (II). Raising or lowering of the handle 42' does not effect the bearing force between bolt and the base by virtue of the first surface 52 contacting the base. The first surface 52 forms a clevis-like means to pivotally attach the handle portion 42' to the eye 32' of the nut and bolt assembly 22. A pivot pin 44 joins the clevis to the eye.

FIG. 7 is still another embodiment of the invention. It illustrates a design where the stem portion 26' of the base is made separable from the base 10'. Here, the stem 26' resembles an inverted "top hat" with the brim portion 56 fit into a countersunk cavity 60 formed in the upper surface 38' of the base 10'. The brim portion 56 of the stem 26' is keyed to the base 10 by means of tabs and grooves. In particular, two notches 64A and 64B are cut in the brim portion 56 of the stem to mate with complementary tabs 62A and 62B in the counterbore 60. The tabs and notches prevent the stem 26' from rotating in the cavity 60 when the nut and bolt assembly 22 are drawn together. The base is compressed on the commode by the shoulder 36' of the head portion of the bolt or the first surface 52 of the handle bearing down on the brim portion 56 of the stem 26'.

While it is true that the location, depth and diameter of toilet seat mounting holes are relatively standardized today, this is not true for older fixtures. In addition if the "overseas market" is considered the variations in commode design is even greater. It is of particular significance that the market for toilet seats and mounting fixtures has its greatest activity in the replacement of older seats on older commodes. Those older commode designs were not subject to a universal design standard. Consequently, the design of a toilet seat mounting fixture must be sufficiently flexible so as to fit into a variety of commode mounting holes. The variation in depth of the mounting hole is illustrated in the drawings by broken lines at the bottom of the commode structure 20 in the vicinity of the mounting holes 23. The embodiment incorporating a separable stem (FIGS. 7 and 8) answers this need for design flexibility in the replacement market. Replacement kits would be available having a variety of stem inserts. Alternatively, the nut and bolt assembly and base could be manufactured for universal replacement with different size stern inserts added depending on the toilet design the seat and cover is intended to replace. This would not only make manufacturing easier but reduce the cost to the consumer. It would also eliminate the need to carry a large inventory of seat hardware.

In the case of the integral stem and base the base is held onto the commode by the contact of the stem with the commode mounting holes. In the case of the separate stem and base assembly the stem primarily anchors the bolt to the mounting holes and the head portion of the bolt compresses the stem onto the base to attach the base to the commode. In other words, the stem becomes an intermediate member and the head portion of the bolt becomes, and is in fact, the principal means used to hold the base onto the commode.

The above detailed description has been given for ease of understanding only. No unnecessary limitations are to be understood therefrom, as modifications will be obvious to those skilled in the art. It is, of course, intended to cover by the appended claims all such modifications as fall within the scope of the claims.

What is claimed is as follows:

1. An apparatus for attaching a toilet seat to a commode, said commode defining at least one mounting hole, comprising:

(a) a base hingedly carrying said seat for joining said seat to said commode, said base resting on said commode, the upper portion of said base having an integral hinge post for coupling said seat to said base, the lower portion of said base carrying a stem disposed within said mounting hole, said stem having longitudinal bore extending therethrough and defining a slit extending from the lower end thereof to a point intermediate the ends thereof to split the wall of said stem along the length of said slit; and (b) removable bolt means operable from the seat side of said commode for outwardly flaring said stem against the periphery of said mounting hole to snugly engage said stem with said commode and thereby attach said base to said commode.

2. The apparatus defined in claim 1, wherein said nut means includes:

(a) a shaft free to rotate in the bore of said stem, said shaft having a head portion at one end engageable with the upper portion of said base; and (b) a nut threadably joined to the other end of said shaft, said bolt and said shaft when carried by the stem being free to pass through said mounting hole, said nut having: an outer diameter larger than the diameter of said bore; a tapered end engageable with the lower end of said stem; and indexing means for mating with said slit and for preventing relative motion between said stem and said nut, said nut being drawn into engagement with said stem and said indexing means engaging said slit by rotation of said head portion in the tightening direction to flare said stem outwardly along said slit and snugly engaging said stem with said commode along the periphery of said mounting hole thereby attaching said base to said commode.

3. An apparatus for attaching a toilet seat to a commode, said commode defining at least one mounting hole, comprising:

(a) a base hingedly carrying said seat for joining said seat to said commode, said base resting on said commode, the upper portion of said base having an integral hinge post for coupling said seat to said base, the lower portion of said base carrying a stem disposed within said mounting hole, said stem having longitudinal bore extending therethrough and defining a slit extending from the lower end thereof to a point intermediate the ends thereof to split the wall of said stem along the length of said slit; and (b) removable bolt means for outwardly flaring said stem against the periphery of said mounting hole to snugly engage said stem with said commode and thereby attach said base to said commode; said bolt means including a shaft free to rotate in the bore of said stem, said shaft having a head portion at one end engageable with the upper portion of said base; and a nut threadably joined to the other end of said shaft, said nut and said shaft when carried by the stem being free to pass through said mounting hole;

said nut having an outer diameter larger than the diameter of said bore; a tapered end engageable with the lower end of said stem; and indexing means for mating with said slit and for preventing relative motion between said stem and said nut, said nut being drawn into engagement with said stem and said indexing means engaging said slit by rotation of said head portion in the tightening direction to flare said stem outwardly along said slit and snugly engaging said stem with said commode along the periphery of said mounting hole thereby attaching said base to said commode.

4. The apparatus defined in claim 1, 2 or 3 including: snap-on cover means, interlocking with said head portion of said shaft and fairing with said base, for concealing said bolt means from view.

5. The apparatus defined in claim 1, 2, or 3, wherein said stem is attached to said base by the head portion of said shaft, said stem being compressed between said base and the head portion of said shaft with the tightening of said nut and shaft.

6. The apparatus defined in claim 5, wherein said stem is retained in position on said base by a complementary interlocking tab and notch, said tab being on one of said base and stem, said notch being on the other of said base and stem.

7. The apparatus defined in claim 1, 2 or 3, wherein said indexing means for mating said slit and for preventing relative motion between said stem and said nut is an integral tab on the outside surface of the tapered end of said nut, said tab being dimensioned to enter said slit upon said nut being drawn toward said stem thereby preventing relative motion between said nut and said stem.

8. The apparatus defined in claim 1 or 3, wherein said stem is integrally formed with said base.

9. The apparatus defined in claim 1 or 3, further including: top means, carried by said bolt means, for holding said base on said commode and operatively engaging and disengaging said bolt means with said commode.

10. The apparatus defined in claim 9, wherein said top means includes a first surface for bearing against the upper portion of said base and a second surface defining a handle graspable by the thumb and forefingers, said top means being pivotally connected to said removable bolt means and rotatable from a raised to a lowered position, said raised position being defined as that position where said second surface is to be manipulated to tighten said removable bolt means and attach said removable bolt means to said commode, said lowered position being defined as that position with said second surface folded against the upper portion of said base.

11. The apparatus defined in claim 10, wherein said base includes an integral means for covering said top means and that portion of said removable bolt means connected to said top means, said integral means being pivotally joined to said base, said integral means enveloping said top means when said top means is in the lowered position, said integral means fairing with said base and forming a contiguous smooth structure thereby obscuring from view said top means and said removable bolt means.

12. The apparatus defined in claim 10, wherein said second surface and said base form complementary interlocking structures with said top means in the lowered position such that said removable bolt means and said top means are disguised from view, said top means and said removable bolt means forming a fairing relative to said base.

13. The apparatus defined in claim 10, wherein said base includes a cavity portion encompassing said bolt means, said cavity being defined by the exposed surfaces of said top means with said top means in said lowered position such that said cavity and said top means form complementary interlocking structures, said top means and said base forming a smooth generally contiguous surfaces covering said cavity portion.

14. The apparatus defined in claim 1, 2 or 3, wherein said nut is symmetrical relative to a plane perpendicular to the axis of said shaft whereby either end of said nut may be threadably joined to said shaft to engage the lower end of said stem along said slit.

15. The apparatus defined in claim 1, 2 or 3, further including a snap-on cover means, interlocking with and joined to said base, for concealing said bolt means from view.

16. The apparatus defined in claim 15, wherein said snap-on cover means is joined to said base by an integral living hinge.

* * * * *

REEXAMINATION CERTIFICATE (300th)

United States Patent [19] [11] B1 4,319,365

Bemis et al. [45] Certificate Issued Feb. 5, 1985

[54] NO TOOL TOILET SEAT HARDWARE

[75] Inventors: Richard A. Bemis, Sheboygan; Gordon Kelly, Elm Grove, both of Wis.

[73] Assignee: Bemis Manufacturing Company, Sheboygan Falls, Wis.

Reexamination Request:
No. 90/000,310, Dec. 23, 1982

Reexamination Certificate for:

| | |
|---|---|
| Patent No.: | **4,319,365** |
| Issued: | **Mar. 16, 1982** |
| Appl. No.: | **120,133** |
| Filed: | **Feb. 11, 1980** |

[51] Int. Cl.[3] ..... A47K 13/12
[52] U.S. Cl. ..... 4/236; 4/240
[58] Field of Search ..... 4/240/

[56] References Cited

U.S. PATENT DOCUMENTS

| | | | |
|---|---|---|---|
| 1,038,834 | 9/1912 | Bloom | 4/240 |
| 3,551,922 | 1/1971 | Watson | 4/240 |
| 3,568,221 | 3/1971 | Haldopoulos | 4/240 |
| 3,570,021 | 3/1971 | Watson | 4/240 |

FOREIGN PATENT DOCUMENTS 758349 5/1967 Canada .

*Primary Examiner*—Henry K. Artis

[57] ABSTRACT

A device for joining a toilet seat and cover to a commode without using tools and from only one side. A base assembly is attached to the commode using a bolt rotated by a hand graspable head portion. A cover conceals the bolt assembly from view. In one embodiment the head portion of the bolt folds out of sight and into engagement with the base; a cover, attached to the base then folds over the handle. In another embodiment the head portion of the expanding bolt folds into the base; the base and the folded head forming complementary interlocking structures disguising the bolt assembly. The bolt employs a nut indexed to a slit on the stem portion of the base. Manipulating the head portion of the bolt draws the nut into engagement with the stem. The outward flaring of the stem anchors the bolt in the mounting holes of the commode. The head portion of the bolt holds the base on the commode. In one embodiment the stem is separable from the base.

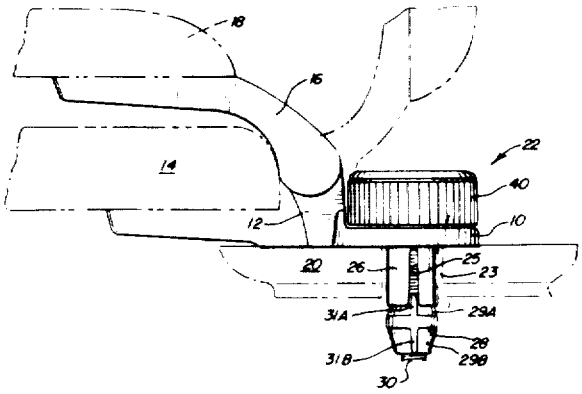

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 6, 7 and 10 are cancelled.

Claims 3–5, 8, 9 and 11–15 are determined to be patentable as amended.

Claim 16 dependent on an amended claim, is determined to be patentable.

New claims 17–20 is added and determined to be patentable.

3. An apparatus for attaching a toilet seat to a commode, said commode defining at least one mounting hole, comprising:

(a) a base hingedly carrying said seat for joining said seat to said commode, said base resting on said commode, the upper portion of said base having an integral hinge post for coupling said seat to said base, the lower portion of said base carrying a stem disposed within said mounting hole, said stem having *a* longitudinal bore extending therethrough and defining a slit extending from the lower end thereof to a point intermediate the ends thereof to split the wall of said stem along the length of said slit; and (b) removable bolt means *operable by hand from the seat side of said commode* for outwardly flaring said stem against the periphery of said mounting hole to snugly engage said stem with said commode and thereby attach said base to said commode; said bolt means including a shaft free to rotate in the bore of said stem, said shaft having a head portion at one end engageable with the upper portion of said base; and a nut threadably joined to the other end of said shaft, said nut and said shaft when carried by the stem being free to pass through said mounting hole;

said nut having [an] *a maximum* outer diameter larger than the diameter of said bore; a tapered end engageable with the *inner surface of the longitudinal bore at the* lower end of said stem; and indexing means for mating with said slit [and], *said indexing means projecting from said tapered end and into said slit for abutting a generally radially oriented stop surface of said stem defining said slit* for preventing relative *rotational* motion between said stem and said nut *before engagement of said tapered end with the inner surface of the longitudinal bore at the lower end of said stem*, said nut being drawn into engagement with said stem and said indexing means engaging said slit *defining stop surface* by rotation of said head portion in the tightening direction to flare said stem outwardly along said slit and snugly engaging said stem with said commode along the periphery of said mounting hole thereby attaching said base to said commode.

4. The apparatus defined in claim [1, 2 or] 3 including: snap-on cover means, interlocking with said head portion of said shaft and fairing with said base, for concealing said bolt means from view.

5. The apparatus defined in claim [1, 2, or] 3, wherein said stem is attached to said base by the head portion of said shaft, said stem being compressed between said base and the head portion of said shaft with the tightening of said nut and shaft.

8. The apparatus defined in claim [1 or] 3, wherein said stem is integrally formed with said base.

9. The apparatus defined in claim [1 or] 3, further including: top means, carried by said bolt means, for holding said base on said commode and operatively engaging and disengaging said bolt means with said commode.

11. The apparatus defined in claim [10,] *19*, wherein said base includes an integral means for covering said top means and that portion of said removable bolt means connected to said top means, said integral means being pivotally joined to said base, said integral means enveloping said top means when said top means is in the lowered position, said integral means fairing with said base and forming a contiguous smooth structure thereby obscuring from view said top means and said removable bolt means.

12. The apparatus defined in claim [10,] *19*, wherein said second surface and said base form complementary interlocking structures with said top means in the lowered position such that said removable bolt means and said top means are disguised from view, said top means and said removable bolt means forming a fairing relative to said base.

13. The apparatus defined in claim [10,] *19*, wherein said base includes a cavity portion encompassing said bolt means, said cavity being defined by the exposed surfaces of said top means with said top means in said lowered position such that said cavity and said top means form complementary interlocking structures, said top means and said base forming a smooth generally contiguous surfaces covering said cavity portion.

14. The apparatus defined in claim [1, 2 or] 3, wherein said nut is symmetrical relative to a plane perpendicular to the axis of said shaft whereby either end of said nut may be threadably joined to said shaft to engage the lower end of said stem along said slit.

15. The apparatus defined in claim [1, 2 or] 3, further including a snap-on cover means, interlocking with and joined to said base, for concealing said bolt means from view.

*17. An apparatus for attaching a toilet seat to a commode, said commode defining at least one mounting hole, comprising:*

*(a) a base hingedly carrying said seat for joining said seat to said commode, said base resting on said commode, the upper portion of said base having an integral hinge post for coupling said seat to said base, the lower portion of said base carrying a stem disposed within said mounting hole, said stem having a longitudinal bore extending therethrough and defining a slit extending from the lower end thereof to a point intermediate the ends thereof to split the wall of said stem along the length of said slit; and*

*(b) removable bolt means operable by hand from the seat side of said commode for outwardly flaring said stem against the periphery of said mounting hole to snugly*

*engage said stem with said commode and thereby attach said base to said commode; said bolt means including a shaft free to rotate in the bore of said stem, said shaft having a head portion at one end engageable with the upper portion of said base; and a nut threadably joined to the other end of said shaft, said nut and said shaft when carried by the stem being free to pass through said mounting hole;*

*said nut having an outer diameter larger than the diameter of said bore, a tapered end engageable with the inner surface of said longitudinal bore at the lower end of said stem, and indexing means for mating with said slit, said indexing means projecting from said tapered end and into said slit for abutting generally radially oriented stop surface of said stem defining said slit for preventing relative rotational motion between said stem and said nut before engagement of said tapered end with the inner surface of the longitudinal bore at the lower end of said slit; said nut being drawn into engagement with said stem and said indexing means engaging said slit defining stop surface by rotation of said head portion in the tightening direction to flare said stem outwardly along said slit and snugly engaging said stem with said commode along the periphery of said mounting hole thereby attaching said base to said commode;*

*said stem being attached to said base by the head portion of said shaft, said stem being compressed between said base and the head portion of said shaft with the tightening of said nut and said shaft;*

*said stem being retained in position on said base by a complementary interlocking tab and notch, said tab being on one of said base and stem, said notch being on the other of said base and stem.*

*18. An apparatus for attaching a toilet seat to a commode, said commode defining at least one mounting hole, comprising:*

*(a) a base hingedly carrying said seat for joining said seat to said commode, said base resting on said commode, the upper portion of said base having an integral hinge post for coupling said seat to said base, the lower portion of said base carrying a stem disposed within said mounting hole, said stem having a longitudinal bore extending therethrough and defining a slit extending from the lower end thereof to a point intermediate the ends thereof to split the wall of said stem along the length of said slit; and*

*(b) removable bolt means operable by hand from the seat side of said commode for outwardly flaring said stem against the periphery of said mounting hole to snugly engage said stem with said commode and thereby attach said base to said commode; said bolt means including a shaft free to rotate in the bore of said stem, said shaft having a head portion at one end engageable with the upper portion of said base; and a nut threadably joined to the other end of said shaft, said nut and said shaft when carried by the stem being free to pass through said mounting hole; said nut having an outer diameter larger than the diameter of said bore, a tapered end engageable with the inner surface of said longitudinal bore at the lower end of said stem, and indexing means for mating with said slit and for preventing relative motion between said stem and said nut, said nut being drawn into engagement with said stem and said indexing means engaging said slit by rotation of said head portion in the tightening direction to flare said stem outwardly along said slit and snugly engaging said stem with said commode along the periphery of said mounting hole thereby attaching said base to said commode;*

*wherein said indexing means for mating with said slit and for preventing relative motion between said stem and said nut is an integral tab on and projecting from the outside surface of the tapered end of said nut, said tab being dimensioned to enter and project into said slit to abut a generally radially oriented surface of said stem which defines said slit before engagement of said tapered end with the inner surface of said longitudinal bore at the lower end of said stem upon said nut being drawn toward said stem thereby preventing relativae motion between said nut and said stem.*

*19. An apparatus for attaching a toilet seat to a commode, said commode defining at least one mounting hole, comprising:*

*(a) a base hingedly carrying said seat for joining said seat to said commode, said base resting on said commode, the upper portion of said base having an integral hinge post for coupling said seat to said base, the lower portion of said base carrying a stem disposed within said mounting hole, said stem having longitudinal bore extending therethrough and defining a slit extending from the lower end thereof to a point intermediate the ends thereof to split the wall of said stem along the length of said slit; and*

*(b) removable bolt means operable from the seat side of said commode for outwardly flaring said stem against the periphery of said mounting hole to snugly engage said stem with said commode and thereby attach said base to said commode;*

*said apapratus further including top means, carried by said bolt means for holding said base on said commode and operatively engaging and disengaging said bolt means with said commode;*

*wherein said top means includes a first surface for bearing against the upper portion of said base and a second surface defining a handle graspable by the thumb and forefingers, said top means being pivotally connected to said removable bolt means and rotatable from a raised to a lowered position, said raised position being defined as that position where said second surface is to be manipulated to tighten said removable bolt means and attach said removable bolt means to said commode, said lowered position being defined as that position with said second surface folded against the upper portion of said base.*

*20. An apparatus for attaching a toilet seat to a commode without tools, said commode defining at least one mounting hole, comprising:*

*(a) a base hingedly carrying said seat for joining said seat to said commode, said base resting on said commode, the upper portion of said base having an integral hinge post for coupling said seat to said base, the lower portion of said base carrying a stem disposed within said mounting hole, said stem having a cylindrical longitudinal bore extending therethrough and defining a slit extending from the lower end thereof to a point intermediate the ends thereof to split the wall of said stem along the length of said slit; and*

*(b) removable bolt means operable by hand from the seat side of said commode for outwardly flaring said stem against the periphery of said mounting hole to snugly engage said stem with said commode and thereby attach said base to said commode; said bolt means including a shaft free to rotate in the bore of said stem, said shaft having a head portion at one end engageable with the upper portion of said base; and a nut*

*threadably joined to the other end of said shaft, said nut and said shaft when carried by the stem being free to pass through said mounting hole; said nut having an outer diameter larger than the diameter of said bore, tapered opposite ends each engageable with the inner surface of said longitudinal bore at the lower end of said stem, and indexing means adapted to project into and mate with said slit said indexing means comprising a pair of indexing tabs respectively projecting from the tapered opposite ends of said nut, each of said tabs being dimensioned to enter and project into said slit for abutting a generally radially oriented stop surface of said stem which defines said slit before engagement of the respective tapered end with the inner surface of the longitudinal bore at the lower end of said stem for preventing relative rotational motion between said stem and said nut, said nut being drawn into engagement with said stem and said indexing means engaging said stop surface which defines said slit by rotation of said head portion in the tightening direction to flare said stem outwardly along said slit and snugly engaging said stem with said commode along the periphery of said mounting hole thereby attaching said base to said commode.*

* * * * *